US011759073B2

(12) United States Patent
Lee et al.

(10) Patent No.: US 11,759,073 B2
(45) Date of Patent: Sep. 19, 2023

(54) MULTI-CYCLONE DUST COLLECTING DEVICE AND VACUUM CLEANER INCLUDING SAME

(71) Applicant: Samsung Electronics Co., Ltd., Suwon-si (KR)

(72) Inventors: Dokyung Lee, Suwon-si (KR); Junggyun Han, Suwon-si (KR); Seehyun Kim, Suwon-si (KR); Yunsoo Jang, Suwon-si (KR); Seungryong Cha, Suwon-si (KR); Ingyu Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 126 days.

(21) Appl. No.: 17/272,278

(22) PCT Filed: Apr. 5, 2019

(86) PCT No.: PCT/KR2019/004086
§ 371 (c)(1),
(2) Date: Feb. 26, 2021

(87) PCT Pub. No.: WO2020/045781
PCT Pub. Date: Mar. 5, 2020

(65) Prior Publication Data

US 2021/0212539 A1 Jul. 15, 2021

(30) Foreign Application Priority Data

Aug. 29, 2018 (KR) ..... 10-2018-0101909
Feb. 12, 2019 (KR) ..... 10-2019-0016181

(51) Int. Cl.
*A47L 9/16* (2006.01)

(52) U.S. Cl.
CPC ..... *A47L 9/1683* (2013.01); *A47L 9/1608* (2013.01); *A47L 9/165* (2013.01); *A47L 9/1641* (2013.01); *A47L 9/1658* (2013.01)

(58) Field of Classification Search
CPC .... A47L 9/1683; A47L 9/1608; A47L 9/1641; A47L 9/165; A47L 9/16; A47L 9/1616; A47L 9/1633
(Continued)

(56) References Cited

U.S. PATENT DOCUMENTS 3,969,096 A 7/1976 Richard
7,678,166 B2 3/2010 Too et al.
(Continued)

FOREIGN PATENT DOCUMENTS

CN 105054864 A 11/2015
CN 105902240 A 8/2016
(Continued)

OTHER PUBLICATIONS

Notice of Preliminary Rejection dated Jun. 13, 2019 in connection with Korean Patent Application No. 10-2019-0016181, 14 pages.
(Continued)

*Primary Examiner* — Brian D Keller
*Assistant Examiner* — Tim Brady

(57) ABSTRACT

A multi-cyclone dust collecting device according to the present disclosure comprises: a primary cyclone formed to primarily separate contaminants from introduced contaminant-containing air; and a plurality of second cyclones which are installed in the primary cyclone so as to separate fine dust from air discharged from the primary cyclone, and each of which has a plurality of introduction ports and one discharge port, wherein the plurality of introduction ports arranged on each of the plurality of secondary cyclones protrude outward from a body of each of the plurality of
(Continued)

secondary cyclones and are formed in tangential directions to the outer circumferential surface of the each of the plurality of secondary cyclones.

10 Claims, 16 Drawing Sheets

(58) Field of Classification Search
USPC ..... 15/353
See application file for complete search history.

(56) References Cited

U.S. PATENT DOCUMENTS

| | | | | |
|---|---|---|---|---|
| 7,771,499 | B2 | 8/2010 | Oh et al. | |
| 7,879,120 | B2 | 2/2011 | Seo et al. | |
| 9,661,969 | B2 | 5/2017 | Riku et al. | |
| 10,194,778 | B2 | 2/2019 | Hyun et al. | |
| 2007/0214756 | A1 | 9/2007 | Lee | |
| 2007/0234687 | A1* | 10/2007 | Ni | B04C 5/04 55/337 |
| 2009/0113859 | A1 | 5/2009 | Oh et al. | |
| 2009/0193772 | A1* | 8/2009 | Oh | A47L 9/1641 55/343 |
| 2012/0167336 | A1* | 7/2012 | Tran | A47L 9/122 15/347 |
| 2013/0160233 | A1 | 6/2013 | Peace et al. | |
| 2013/0291334 | A1* | 11/2013 | Peng | A47L 9/1641 15/353 |
| 2014/0237756 | A1* | 8/2014 | Conrad | A47L 9/0018 15/329 |
| 2016/0143498 | A1 | 5/2016 | Gu et al. | |
| 2016/0174802 | A1* | 6/2016 | Conrad | A47L 9/2878 15/329 |
| 2016/0206169 | A1* | 7/2016 | Hyun | B04C 5/28 |
| 2017/0055792 | A1* | 3/2017 | Gu | A47L 9/1633 |
| 2017/0303759 | A1* | 10/2017 | Conrad | B04C 5/28 |
| 2017/0319029 | A1* | 11/2017 | Hyun | B01D 45/16 |
| 2018/0177354 | A1* | 6/2018 | Conrad | A47L 9/1641 |
| 2018/0271343 | A1* | 9/2018 | Hyun | A47L 9/1683 |

FOREIGN PATENT DOCUMENTS

| | | | |
|---|---|---|---|
| CN | 108209722 | A | 6/2018 |
| EP | 1842475 | B1 | 10/2011 |
| KR | 10-0767122 | B1 | 10/2007 |
| KR | 10-2008-0061102 | A | 7/2008 |
| KR | 10-2009-0046659 | A | 5/2009 |
| KR | 10-1472784 | B1 | 12/2014 |
| KR | 10-2016-0089202 | A | 7/2016 |
| KR | 10-2016-0099730 | A | 8/2016 |
| KR | 10-1649245 | B1 | 8/2016 |
| WO | 2014/027498 | A1 | 2/2014 |

OTHER PUBLICATIONS

Notice of Preliminary Rejection dated Oct. 30, 2019 in connection with Korean Patent Application No. 10-2019-0016181, 13 pages.
Decision to Grant a Patent dated Jan. 17, 2020 in connection with Korean Patent Application No. 10-2019-0016181, 1 page.
International Search Report dated Jul. 9, 2019 in connection with International Patent Application No. PCT/KR201 9/004086, 2 pages.
Written Opinion of the International Searching Authority dated Jul. 9, 2019 in connection with International Patent Application No. PCT/KR2019/004086,4 pages.

* cited by examiner

MULTI-CYCLONE DUST COLLECTING DEVICE AND VACUUM CLEANER INCLUDING SAME

CROSS-REFERENCE TO RELATED APPLICATIONS

This application is a 371 of International Application No. PCT/KR2019/004086 filed on Apr. 5, 2019, which claims priority to Korean Patent Application No. 10-2018-0101909 filed on Aug. 29, 2018 and Korean Patent Application No. 10-2019-0016181 filed on Feb. 12, 2019, the disclosures of which are herein incorporated by reference in their entirety.

BACKGROUND

1. Field

The disclosure relates to a cyclone dust collecting device used in a vacuum cleaner, and more particularly, to a multi-cyclone dust collecting device including a primary cyclone and a plurality of secondary cyclones, and a vacuum cleaner having the same.

2. Description of Related Art

Instead of wired vacuum cleaners that receive electricity by connecting a wire to an external power source, wireless vacuum cleaners that operate using electricity output from an internal battery without connecting a wire to an external power source are widely used.

In such a wireless vacuum cleaner, a multi-cyclone dust collecting device using centrifugal force is used as a dust collecting device for collecting dust and dirt.

The multi-cyclone dust collecting device includes a primary cyclone that separates and collects dirt and dust from air containing dirt and dust introduced from the outside, and a plurality of secondary cyclones that separate fine dust from the air discharged from the primary cyclone.

In the case of the secondary cyclone, a pressure loss occurs due to a pressure difference between the air entering the inlet and the air exiting the outlet.

As the pressure loss of the multi-cyclone dust collecting device increases, a suction force of the vacuum cleaner itself, that is, the cleaning performance decreases, so it is necessary to minimize the pressure loss.

In this case, when the pressure loss is reduced, the separation efficiency of the multi-cyclone dust collecting device may be reduced. Therefore, a multi-cyclone dust collecting device capable of minimizing the pressure loss while maintaining the separation efficiency of the multi-cyclone dust collecting device is required.

Provided is a multi-cyclone dust collecting device capable of reducing pressure loss while maintaining separation efficiency substantially the same as that of a conventional multi-cyclone dust collecting device, and a vacuum cleaner having the same.

SUMMARY

According to an aspect of the disclosure, there is provided a multi-cyclone dust collecting device including: a primary cyclone formed to firstly separate dirt from an introduced dirt-containing air; and a plurality of secondary cyclones disposed inside the primary cyclone and formed to separate fine dust from air discharged from the primary cyclone, each of the plurality of secondary cyclone including a plurality of inlets and one outlet, wherein the plurality of inlets provided in each of the plurality of secondary cyclones protrude outward from a body of each of the plurality of secondary cyclones and are formed in a tangential direction with respect to an outer circumferential surface of each of the plurality of secondary cyclones.

The plurality of inlets may be provided on an upper end of the outer circumferential surface of each of the plurality of secondary cyclones.

Each of the plurality of secondary cyclones may include a hollow cylindrical portion provided with the plurality of inlets; a hollow truncated cone provided at a lower end of the hollow cylindrical portion; and a top plate disposed on an upper end of the cylindrical portion and provided with the outlet.

The cylindrical portion may be integrally formed with the truncated cone, and the top plate may be formed separately from the cylindrical portion.

Each of the plurality of inlets may include an inlet duct formed to allow air to be introduced in a tangential direction with respect to an outer circumferential surface of the cylindrical portion.

A cross-sectional area of each of the plurality of inlets may be less than or equal to a cross-sectional area of the outlet.

Each of the plurality of inlets may include an opening formed in each of the plurality of secondary cyclones; and an inlet duct formed to surround the opening.

The inlet duct may include an inflow guide wall disposed in a tangential direction with respect to the outer circumferential surface of the secondary cyclone; a top wall connecting an upper end of the inflow guide wall and an upper end of the secondary cyclone; and a bottom wall disposed in parallel with the top wall and connecting a lower end of the inflow guide wall and the outer circumferential surface of the secondary cyclone.

Each of the plurality of inlets may further include an adjusting portion extending from the outer circumferential surface of the secondary cyclone corresponding to a start end of the inlet duct toward the opening.

The adjusting portion may extend along a virtual circle corresponding to the outer circumferential surface of the secondary cyclone.

The outlet of the secondary cyclone may include a discharge pipe, and a lower end of the discharge pipe may be positioned at a same level as or at a lower level than a lower end of each of the plurality of inlet ducts.

The primary cyclone may be configured to discharge air into an intermediate chamber, and the plurality of inlets of each of the plurality of secondary cyclones may be provided to open toward the intermediate chamber.

The multi-cyclone dust collecting device may include a housing forming the primary cyclone; an intermediate wall disposed inside the housing and partitioning the plurality of secondary cyclones and the housing; a dust collecting chamber provided under the plurality of secondary cyclones and configured to collect fine dust separated in the plurality of secondary cyclones; a lower plate disposed inside the intermediate wall to partition between lower ends of the plurality of secondary cyclones and the dust collecting chamber; and an upper plate disposed on the upper ends of the plurality of secondary cyclones to block a space between the plurality of secondary cyclones.

A porous member may be disposed along an entire circumference at a portion of the intermediate wall corresponding between the upper plate and the lower plate.

According to another aspect of the disclosure, a vacuum cleaner may include a suction nozzle; a multi-cyclone dust collecting device connected to the suction nozzle; and a suction motor connected to the multi-cyclone dust collecting device and configured to generate a suction force, wherein the multi-cyclone dust collecting device may include: a primary cyclone formed to firstly separate dirt from an introduced dirt-containing air; and a plurality of secondary cyclones disposed inside the primary cyclone and formed to separate fine dust from air discharged from the primary cyclone, each of the plurality of secondary cyclones including a plurality of inlets and one outlet, wherein the plurality of inlets provided in each of the plurality of secondary cyclones protrude outward from a body of each of the plurality of secondary cyclones and are formed in a tangential direction with respect to an outer circumferential surface of each of the plurality of secondary cyclones.

According to the multi-cyclone dust collecting device according to an embodiment of the disclosure having the structure as described above, there is an advantage of reducing pressure loss while maintaining the separation efficiency almost the same as that of the conventional multi-cyclone dust collecting device.

DETAILED DESCRIPTION

Hereinafter, embodiments of a multi-cyclone dust collecting device according to the disclosure and a vacuum cleaner having the same will be described in detail with reference to the accompanying drawings.

Various embodiments of the disclosure will hereinafter be described with reference to the accompanying drawings. However, it is to be understood that technologies mentioned in the disclosure are not limited to specific embodiments, but include various modifications, equivalents, and/or alternatives according to embodiments of the disclosure. The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of exemplary embodiments. Further, dimensions of various elements in the accompanying drawings may be arbitrarily increased or decreased for assisting in a comprehensive understanding.

The terms 'first', 'second', etc. may be used to describe diverse components, but the components are not limited by the terms. The terms may only be used to distinguish one component from the others. For example, without departing from the scope of the present disclosure, a first component may be referred to as a second component, and similarly, a second component may also be referred to as a first component.

The terms used in embodiments of the present disclosure may be construed as commonly known to those skilled in the art unless otherwise defined.

Further, the terms 'leading end', 'rear end', 'upper side', 'lower side', 'top end', 'bottom end', etc. used in the present disclosure are defined with reference to the drawings. However, the shape and position of each component are not limited by the terms.

The disclosure is related to a multi-cyclone dust collecting device that is disposed in a vacuum cleaner, separates dirt and dust from an air containing dirt and dust (hereinafter referred to as dirt-containing air) sucked by a suction force generated by a suction motor, and discharges a cleaned air to the outside.

Figure 1:
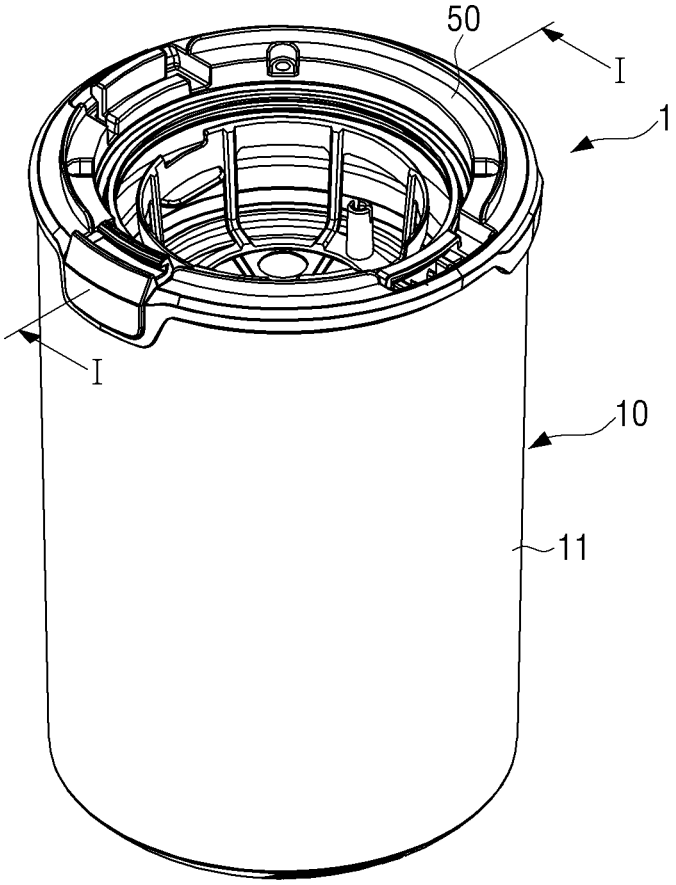
FIG. 1 is a perspective view illustrating a multi-cyclone dust collecting device according to an embodiment of the disclosure.
Figure 2:
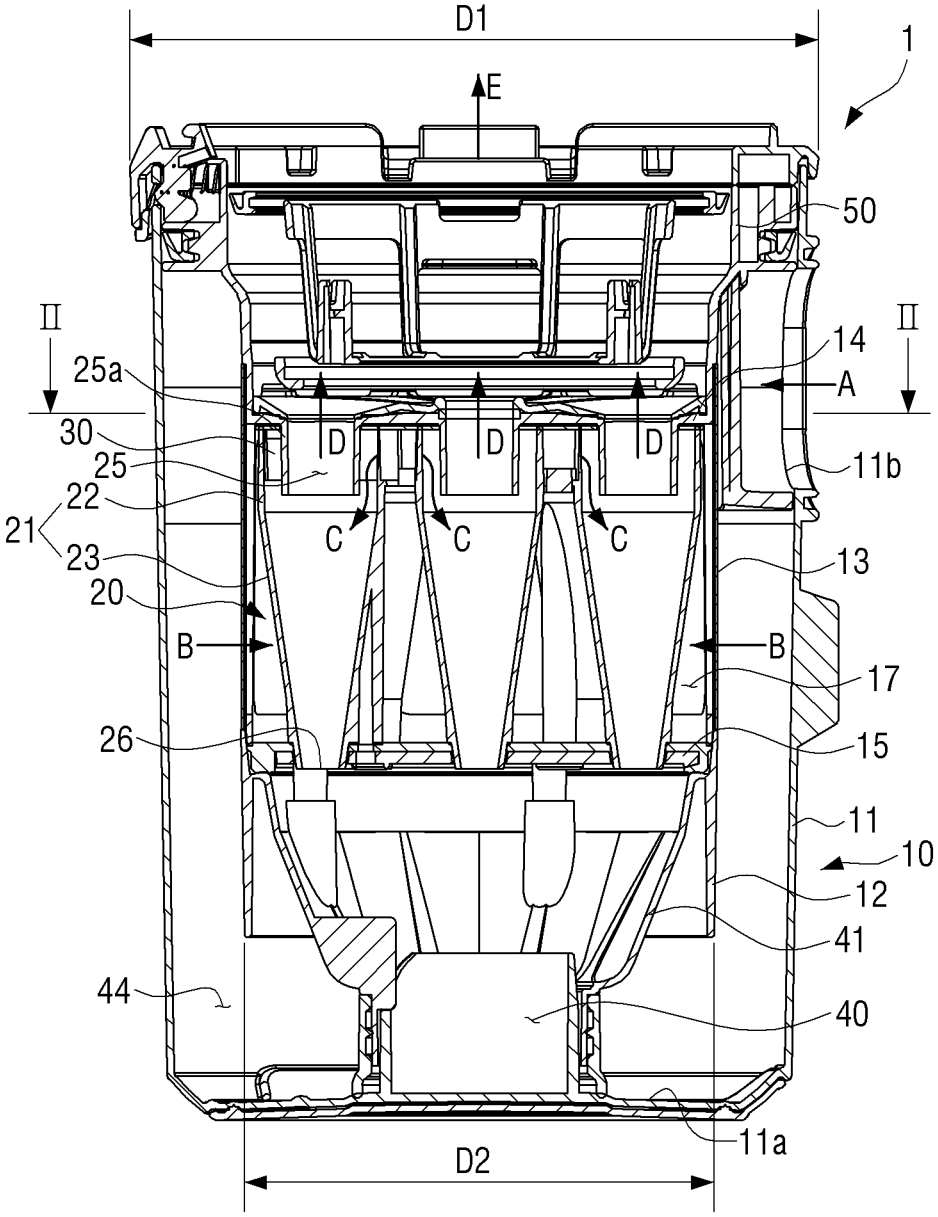
FIG. 2 is a cross-sectional view illustrating the multi-cyclone dust collecting device of FIG. 1 taken along line I-I.

FIG. 1 is a perspective view illustrating a multi-cyclone dust collecting device according to an embodiment of the disclosure. FIG. 2 is a cross-sectional view illustrating the multi-cyclone dust collecting device of FIG. 1 taken along line I-I, and FIG. 3 is a cross-sectional view illustrating the multi-cyclone dust collecting device of FIG. 2 taken along line II-II.

Figure 3:
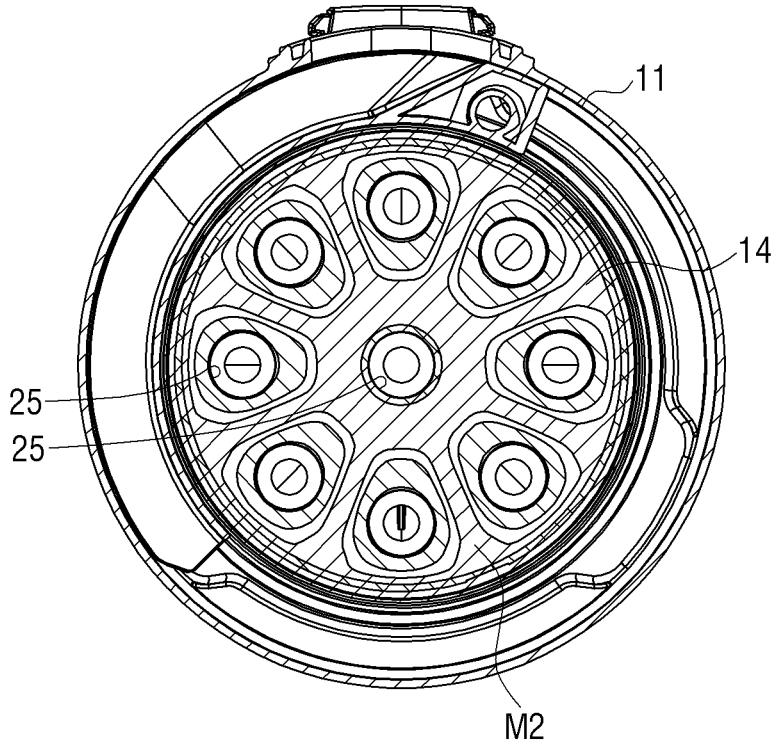
FIG. 3 is a cross-sectional view illustrating the multi-cyclone dust collecting device of FIG. 2 taken along line II-II.

Referring to FIGS. 1 to 3, a multi-cyclone dust collecting device 1 according to an embodiment of the disclosure may include a primary cyclone 10 and a plurality of secondary cyclones 20.

The primary cyclone 10 may be formed to separate large-sized dirt and dust by using a centrifugal force acting on the dirt-containing air by allowing the introduced dirt-containing air to whirl. The air from which dirt and dust are first separated in the primary cyclone 10 is discharged to the plurality of secondary cyclones 20.

The primary cyclone 10 may be implemented by a housing 11 forming the appearance of the multi-cyclone dust collecting device 1 and an intermediate wall 12 disposed inside the housing 11.

The housing 11 may be formed in a substantially hollow cylindrical shape, and may include a bottom 11*a* formed at one end of the housing 11. In other words, the housing 11 may be formed in the shape of a cylindrical container with the bottom 11*a*. An inlet 11*b* through which outside dirt-containing air is introduced may be provided on the upper portion of the outer circumferential surface of the housing 11, that is, on the upper portion of a sidewall of the housing 11. The inlet 11*b* of the housing 11 may communicate with a suction nozzle 170 (see FIG. 11) of a vacuum cleaner 100 through an extension pipe 160 (see FIGS. 11 and 12). Accordingly, dirt and dust on the surface to be cleaned sucked through the suction nozzle 170 may be introduced into the primary cyclone 10 through the inlet 11*b*.

The intermediate wall 12 may be formed in a hollow cylindrical shape and may be disposed concentrically with the housing 11 inside the housing 11. Because the intermediate wall 12 is spaced apart from the sidewall of the housing 11 by a predetermined distance, a donut-shaped space may be formed between the intermediate wall 12 and the housing 11. The dirt-containing air introduced into the inlet 11*b* of the housing 11 may whirl in the space between the intermediate wall 12 and the sidewall of the housing 11. Dirt and dust separated by the centrifugal force in the primary cyclone 10 may be collected on the bottom 11*a* of the housing 11.

The intermediate wall 12 may include a porous member 13. The porous member 13 may be provided along the entire circumference of the intermediate wall 12 at an approximately middle portion in the longitudinal direction of the intermediate wall 12. The porous member 13 may be formed in a shape having a plurality of holes, such as a grill, a filter, or the like. Accordingly, the porous member 13 may allow air to pass through, but does not allow large-sized dirt and dust to pass through. The porous member 13 may function as an outlet through which air from which dirt and dust is first removed in the primary cyclone 10 is discharged. Accordingly, the inner space of the intermediate wall 12 may form an intermediate chamber 17 in which air discharged from the primary cyclone 10 through the porous member 13 collects.

The plurality of secondary cyclones 20 may be disposed inside the intermediate wall 12, that is, in the intermediate chamber 17. Accordingly, the intermediate wall 12 may partition the plurality of secondary cyclones 20 and the primary cyclone 10.

The plurality of secondary cyclones 20 may be formed to separate fine dust from the air discharged from the primary cyclone 10. The air discharged from the primary cyclone 10 may be in a state in which large-sized dirt and dust are removed and fine dust is contained.

Figure 11:
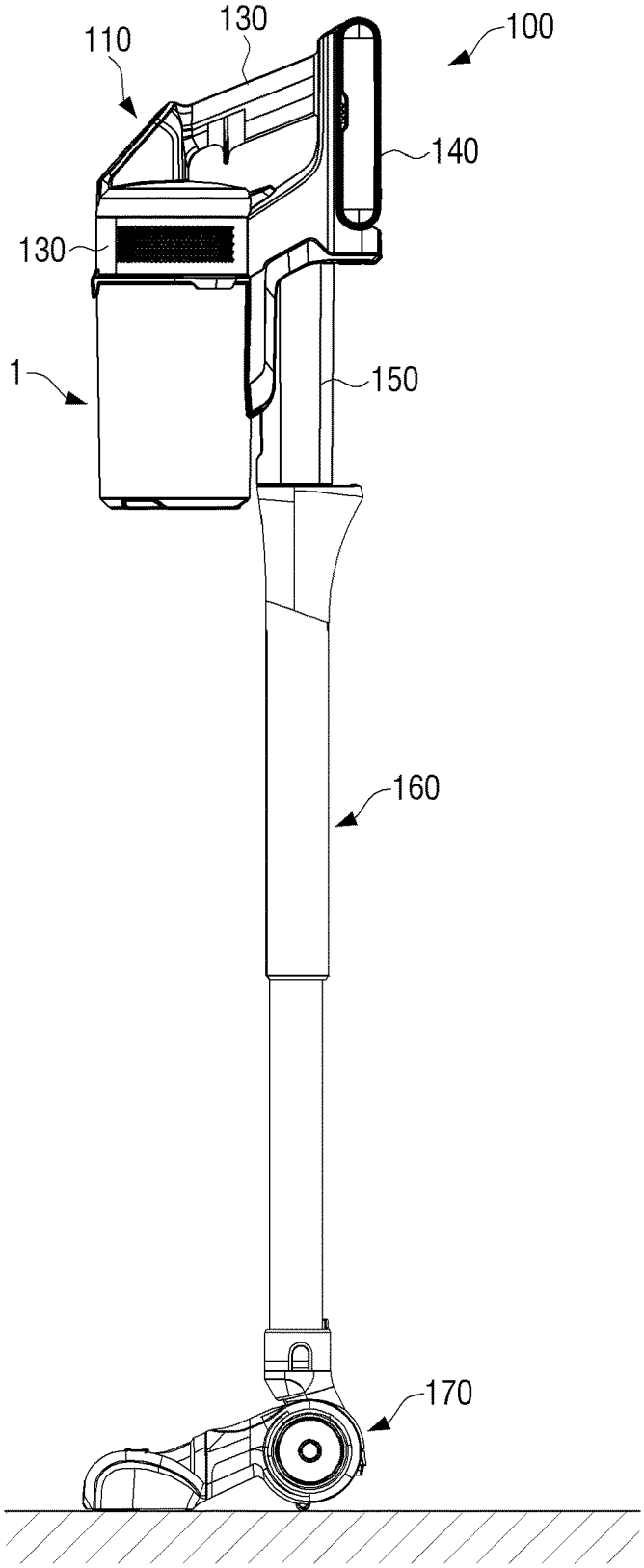
FIG. 11 is a view illustrating a wireless stick cleaner having a multi-cyclone dust collecting device according to an embodiment of the disclosure.

In this embodiment, as illustrated in FIG. 3, nine secondary cyclones 20 are arranged in a circular shape. In detail, one secondary cyclone 20 is disposed at the center, and eight secondary cyclones 20 are disposed in a circular shape around the secondary cyclone 20 disposed at the center (see FIG. 7). This structure may be applied when the multi-cyclone dust collecting device 1 according to an embodiment of the disclosure is used in a wireless stick cleaner 100 as illustrated in FIG. 11.

However, the number and arrangement of the plurality of secondary cyclones 20 described above is only an example, and the plurality of secondary cyclones 20 may be arranged in various numbers and in various shapes depending on the vacuum cleaner to which the multi-cyclone dust collecting device 1 is applied.

Each of the plurality of secondary cyclones 20 may include a plurality of inlets 30 and one outlet 25. In other words, one secondary cyclone 20 may include a plurality of inlets 30 and one outlet 25.

The plurality of inlets 30 may be formed to protrude outward from the outer circumferential surface of the secondary cyclone 20, and may be open toward the intermediate chamber 17. In detail, each of the plurality of inlets 30 may be formed to protrude outward from the outer circumferential surface of a body 21 of the secondary cyclone 20. In addition, each of the plurality of secondary cyclones 20 may be formed in a tangential direction with respect to the secondary cyclone 20. In other words, each inlet 30 may be formed to protrude outward in a tangential direction with respect to the outer circumferential surface of the body 21 of the secondary cyclone 20. Accordingly, air in the intermediate chamber 17 may be introduced into the secondary cyclone 20 in the tangential direction.

The outlet 25 may be formed at the top of the secondary cyclone 20. In detail, the outlet 25 may be formed at the center of the top of the body 21 of the secondary cyclone 20. A specific shape of each of the plurality of secondary cyclones 20 will be described in detail below.

A lower plate 15 may be disposed at the lower end of the plurality of secondary cyclones 20 to block the lower portion of the intermediate wall 12. In other words, the lower plate 15 may be disposed inside the intermediate wall 12, and may divide a dust collecting chamber 40 provided under the plurality of secondary cyclones 20 and the intermediate chamber 17 in which the plurality of secondary cyclones 20 are disposed. The lower plate 15 may have a plurality of holes into which lower ends of the plurality of secondary cyclones 20 are inserted.

The dust collecting chamber 40 may be provided under the plurality of secondary cyclones 20, and may be formed to collect fine dust separated in the plurality of secondary cyclones 20. The dust collecting chamber 40 may be formed as a dust collecting container 41 extending substantially in a funnel shape upward from the center portion of the bottom 11*a* of the housing 11. The dust collecting container 41 may be surrounded by a portion of the intermediate wall 12 extending a predetermined length downward beyond the lower plate 15.

In addition, the space around the outer periphery of the dust collecting container 41 in the bottom 11*a* of the housing 11 may form a dirt collecting chamber 44 in which the dirt separated by the primary cyclone 10 is collected. The dust collecting chamber 40 may be shielded with the dust collecting container 41 so as not to communicate with the dirt collecting chamber 44.

An upper plate 14 may be disposed at the upper end of the plurality of secondary cyclones 20 to block the upper portion of the intermediate wall 12. The upper plate 14 may block the upper ends of the plurality of secondary cyclones 20. In addition, the upper plate 14 may close gaps between the plurality of secondary cyclones 20 so that the intermediate chamber 17 in which the plurality of secondary cyclones 20 are disposed does not communicate with the outside. Accordingly, the space surrounded by the intermediate wall 12, the upper plate 14, and the lower plate 15 may form the intermediate chamber 17 in which the plurality of secondary cyclones 20 are disposed.

The upper plate 14 may have a plurality of outlets 25 corresponding to the plurality of secondary cyclones 20.

Each of the plurality of outlets 25 may be formed in a circular pipe shape. Accordingly, when the upper plate 14 covers the upper ends of the plurality of secondary cyclones 20, the outlet 25 may be positioned at the upper end of each of the plurality of secondary cyclones 20 as illustrated in FIG. 2. Therefore, the air introduced into the intermediate chamber 17 may be introduced into the inlets 30 of the plurality of secondary cyclones 20, may whirl inside the secondary cyclones 20, and then may be discharged to the outside through the outlets 25, respectively.

A base 50 that functions as a passage for air discharged from the plurality of secondary cyclones 20 and allows the multi-cyclone dust collecting device 1 to be fixed to a vacuum cleaner may be provided on the upper side of the plurality of secondary cyclones 20. The base 50 may communicate with a suction motor configured to generate a suction force. The multi-cyclone dust collecting device 1 according to this embodiment may be disposed in the wireless stick cleaner 100 as illustrated in FIG. 11 and a robot cleaner 200 as illustrated in FIG.

The base 50 may be formed in a substantially hollow cylindrical shape. The upper plate 14 may be disposed at the lower end of the base 50, and the upper end of the base 50 may be opened. Accordingly, the air discharged from the outlet 25 of each of the plurality of secondary cyclones 20 may pass through the interior of the base 50 and may be discharged through the upper end of the base 50.

The above-described intermediate wall 12 may be formed to extend from the lower end of the base 50. In addition, the housing 11 may be disposed to be detachable from the upper portion of the base 50 outside the intermediate wall 12.

Hereinafter, each of a plurality of secondary cyclones of a multi-cyclone dust collecting device according to an embodiment of the disclosure will be described in detail with reference to FIGS. 4 to 6. For reference, because all of the plurality of secondary cyclones 20 are formed identically, it will be described below based on one secondary cyclone 20.

Figure 4:
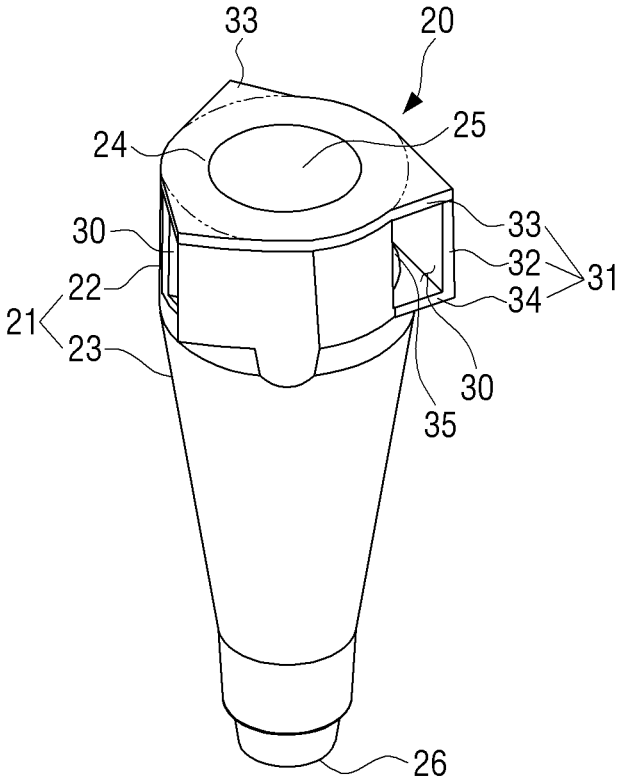
FIG. 4 is a perspective view illustrating a secondary cyclone of a multi-cyclone dust collecting device according to an embodiment of the disclosure.

FIG. 4 is a perspective view illustrating a secondary cyclone of a multi-cyclone dust collecting device according to an embodiment of the disclosure. FIG. 5 is a plan view illustrating the secondary cyclone of FIG. 4, and FIG. 6 is a longitudinal sectional view illustrating the secondary cyclone of FIG. 4.

Figure 5:
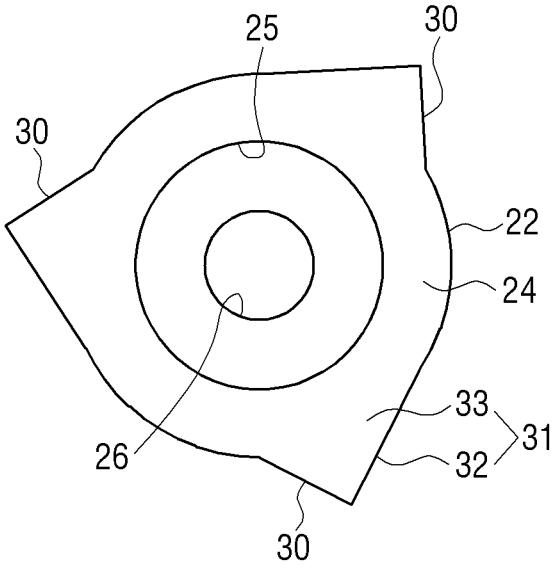
FIG. 5 is a plan view illustrating the secondary cyclone of FIG. 4.
Figure 6:
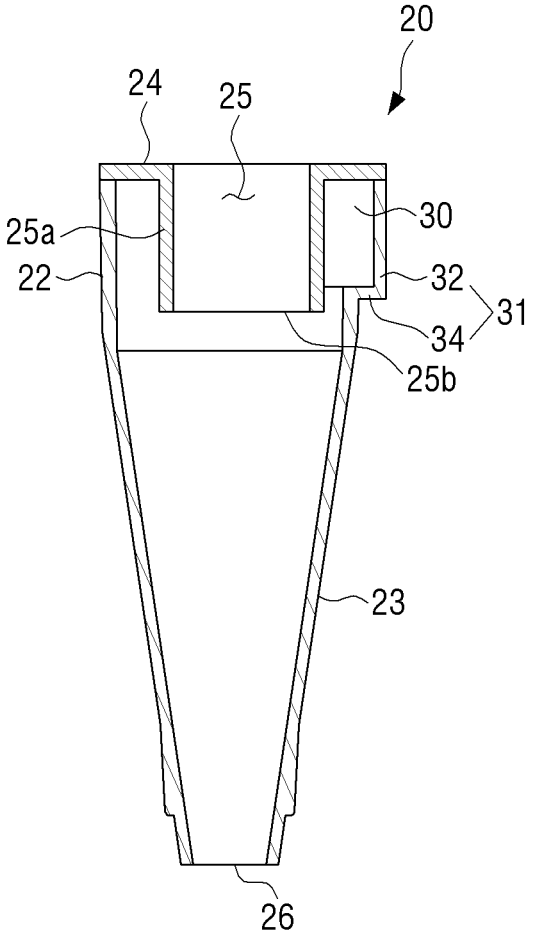
FIG. 6 is a longitudinal sectional view illustrating the secondary cyclone of FIG. 4.

Referring to FIGS. 4 to 6, the secondary cyclone 20 according to an embodiment of the disclosure may include a cylindrical portion 22, a truncated cone 23, and a top plate 24.

The cylindrical portion 22 may be formed in a hollow cylindrical shape, and the plurality of inlets 30 may be provided on the outer circumferential surface of the cylindrical portion 22. The plurality of inlets 30 may be formed to protrude outward from the outer circumferential surface of the cylindrical portion 22 of the secondary cyclone 20. In addition, each of the plurality of inlets 30 may be formed in a tangential direction with respect to the outer circumferential surface of the cylindrical portion 22 of the secondary cyclone 20. In other words, each of the plurality of inlets 30 may protrude outward from the outer circumferential surface of the cylindrical portion 22 of the secondary cyclone 20 and may be formed in the tangential direction with respect to the outer circumferential surface of the cylindrical portion 22.

The plurality of inlets 30 may be formed to be tangent to the outer circumferential surface of the cylindrical portion 22 having the largest diameter. Separation efficiency may be maintained by forming the plurality of inlets 30 on the outer circumferential surface of the cylindrical portion 22 having the largest diameter of the secondary cyclone 20 as described above. In addition, when the plurality of inlets 30 are formed in the secondary cyclone 20, the pressure loss generated in the secondary cyclone 20 may be reduced compared to the secondary cyclone according to the prior art having a single inlet. In addition, when the plurality of inlets are formed to protrude from the outer circumferential surface of the secondary cyclone 20, a flow path of air may be formed so that the air in the intermediate chamber 17 passes through the plurality of inlets 30 and smoothly enters the interior of the secondary cyclone 20. In addition, because the plurality of inlets 30 are formed in the tangential direction on the outer circumferential surface of the secondary cyclone 20, the air may be introduced in the tangential direction into the interior of the secondary cyclone 20 through the plurality of inlets 30. Therefore, the centrifugal force acting on the air turning inside the secondary cyclone 20 may be maximized.

The truncated cone 23 may be provided at the lower end of the cylindrical portion 22, and may be formed in a hollow shape. The lower end of the truncated cone 23 may be open to form a dust outlet 26 through which separate dust is discharged. In addition, the truncated cone 23 may be formed integrally with the cylindrical portion 22 to form the body 21 of the secondary cyclone 20.

The top plate 24 may be disposed on the upper end of the cylindrical portion 22, and may be provided with the outlet 25 through which the air introduced into the secondary cyclone 20 through the plurality of inlets 30 is discharged. The top plate 24 may be formed in a disk shape corresponding to the cylindrical portion 22 so as to block the upper end of the cylindrical portion 22. The outlet 25 may be disposed in the center of the top plate 24. The outlet 25 may be formed as a discharge pipe 25*a* having a circular pipe shape of a predetermined length.

The top plate 24 of the secondary cyclone 20 may be formed separately from the cylindrical portion 22 so as to facilitate the molding of the secondary cyclone 20. In addition, the cylindrical portion 22 including the plurality of inlets 30 may be integrally formed with the truncated cone 23. In other words, the secondary cyclone 20 may be formed by separately molding the top plate 24 including the outlet 25 and the body 21 including the truncated cone 23 and the cylindrical portion 22.

Figure 7:
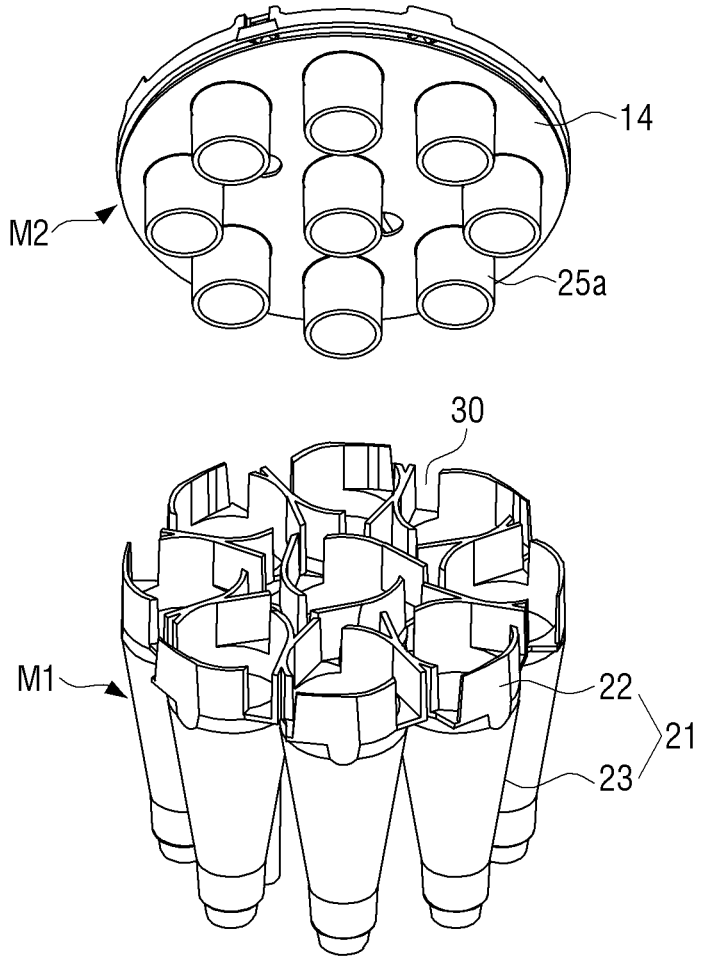
FIG. 7 is an exploded perspective view illustrating a state in which an upper plate is separated from an integral body of a plurality of secondary cyclones of a multi-cyclone dust collecting device according to an embodiment of the disclosure.

In the case of using the plurality of secondary cyclones 20 as in this embodiment, as illustrated in FIG. 7, the plurality of cylindrical portions 22 and the plurality of truncated cones 23 may be molded into one injection product M1, and the plurality of top plates 24 may be molded into one injection product M2 that is formed in a disk shape and has a plurality of discharge pipes 25*a*, that is, the upper plate 14. The injection product M1, that is, the upper plate 14 including the plurality of top plates 24 may be coupled to the upper end of the injection product M1 forming the body 21 of the plurality of secondary cyclones 20. When the upper ends of the plurality of secondary cyclones 20 are covered with the upper plate 14 as described above, a portion of the upper plate 14 corresponding to the upper end of each of the plurality of secondary cyclones 20 may form the above-described top plate 24 of the secondary cyclone 20. Here, FIG. 7 is an exploded perspective view illustrating a state in which an upper plate is separated from an integral body of a plurality of secondary cyclones of a multi-cyclone dust collecting device according to an embodiment of the disclosure.

Figure 8:
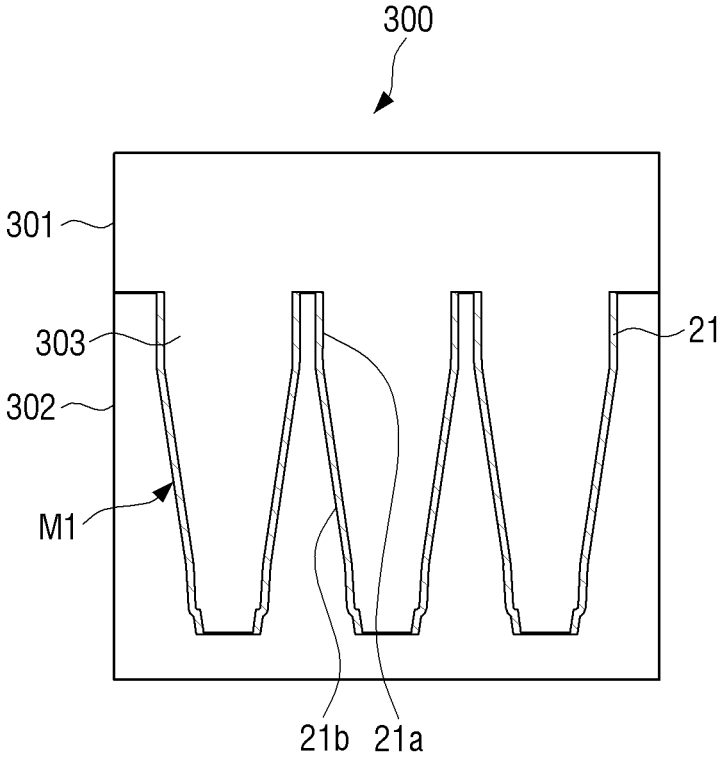
FIG. 8 is a cross-sectional view schematically illustrating a mold for molding an injection product forming a body of a plurality of secondary cyclones of a multi-cyclone dust collecting device according to an embodiment of the disclosure.

FIG. 8 is a cross-sectional view schematically illustrating a mold for molding an injection product forming an integral body of a plurality of secondary cyclones.

Referring to FIG. 8, the inner surface 21*a* of the body 21 of the secondary cyclone has a shape without engaging portions from the bottom to the top so that the core 303 of the upper mold 301 may be easily removed from the inside of the body 21. In addition, the outer surface 21*b* of the body 21 of the secondary cyclone is formed in a shape without engaging portions from the top to the bottom so that the injection product M1 may be easily taken out from the lower mold 302. Accordingly, the bodies 21 of the plurality of secondary cyclones 20 may be formed as one injection product M1 using one mold 300.

When the bodies 21 of the plurality of secondary cyclones 20 are formed as one injection product M1 as described above, the number of parts may be reduced compared to the prior art in which the bodies of the secondary cyclones are formed as two injection products, and the problem of sealing between the two injection products may also be solved.

The plurality of inlets 30 may be provided on the outer circumferential surface of the cylindrical portion 22 of the secondary cyclone 20 at regular intervals. In the case of this embodiment, three inlets 30 are provided in the secondary cyclone 20. However, this is only an example; therefore, two or four or more inlets 30 may be formed in the secondary cyclone 20.

In this case, the plurality of inlets 30 may be formed so that a cross-sectional area of each of the plurality of inlets 30 is less than or equal to the cross-sectional area of the outlet 25 of the secondary cyclone 20. In other words, the cross-sectional area of one inlet 30 may be formed so as not to be larger than the cross-sectional area of the outlet 25 of the secondary cyclone 20.

In addition, the plurality of inlets 30 may be formed so that the lower end 34 of the inlet 30 is positioned at the same or higher level as the lower end 25*b* of the discharge pipe 25*a* forming the outlet 25 as illustrated in FIG. 6. In other words, the lower end 25*b* of the discharge pipe 25*a* may be disposed to be positioned at the same or lower level as the lower end 34 of each of the plurality of inlets 30.

The plurality of inlets 30 may include a plurality of openings 35 formed on the outer circumferential surface of the secondary cyclone 20 and a plurality of inlet ducts 31 formed to protrude from the outer circumferential surface of the secondary cyclone 20 and to surround the plurality of openings 35. In other words, each inlet 30 of the secondary cyclone 20 may include the opening 35 formed at an upper end of the outer circumferential surface of the cylindrical portion 22 and the inlet duct 31 surrounding the opening 35.

The inlet duct 31 may be formed in an approximately triangular column shape, and may allow air to be introduced in a tangential direction with respect to the outer circumferential surface of the secondary cyclone 20. In detail, as illustrated in FIG. 4, the inlet duct 31 may include an inflow guide wall 32 disposed in a tangential direction with respect to the body 21 of the secondary cyclone 20, a top wall 33 connecting the upper end of the inflow guide wall 32 and the upper end of the secondary cyclone 20, and a bottom wall 34 that is disposed parallel to the top wall 33 and connects the lower end of the inflow guide wall 32 and the outer circumferential surface of the body 21 of the secondary cyclone 20. Accordingly, the inlet of the inlet duct 31 formed by the inflow guide wall 32, the top wall 33, and the bottom wall 34 may be formed in a substantially rectangular shape. The rectangular area of the entrance of the inlet duct 31 may be referred to as the cross-sectional area of the inlet 30. Accordingly, the rectangular area of the entrance of the inlet duct 31 may be formed to be less than or equal to the cross-sectional area of the outlet 25 of the secondary cyclone 20.

The inflow guide wall 32 may be formed in a substantially rectangular flat shape, and may be disposed in a tangential direction with respect to the cylindrical portion 22 of the secondary cyclone 20. In other words, the inflow guide wall 32 may be disposed in a tangential direction at one end of the opening 35 of the cylindrical portion 22 of the secondary cyclone 20.

The bottom wall 34 may be formed in a substantially triangular flat plate, and may connect the lower end of the inflow guide wall 32 and the side surface of the cylindrical portion 22 of the secondary cyclone 20. Accordingly, the side of the bottom wall 34 in contact with the side surface of the cylindrical portion 22 may be formed in an arc shape corresponding to the cylindrical portion 22 of the secondary cyclone 20. The bottom wall 34 may form the lower end of the inlet 30. Accordingly, the bottom wall 34 may be disposed at the same or higher level as the lower end 25*b* of the discharge pipe 25*a* forming the outlet 25.

The top wall 33 may be formed in a shape corresponding to the bottom wall 34. In other words, the top wall 33 may be formed in a substantially triangular flat plate, and may connect the upper end of the inflow guide wall 32 and the upper end of the secondary cyclone 20, that is, the top plate 24. Accordingly, the side of the top wall 33 in contact with the top plate 24 may be formed in an arc shape corresponding to the top plate 24 of the secondary cyclone 20. In this case, the top wall 33 of the inlet duct 31 may be integrally formed with the top plate 24 of the secondary cyclone 20. In other words, as illustrated in FIG. 5, the top wall 33 having a substantially triangular shape may protrude from the top plate 24 having a disk shape. In the case of this embodiment, because three inlets 30 are provided, three top walls 33 may be integrally formed on the top plate 24. In the case where the top plates 24 of the secondary cyclones 20 are formed as a single injection product M2, that is, the upper plate 14 as illustrated in FIG. 7, as in this embodiment, the top wall 33 of the inlet duct 31 may be formed as a part of the upper plate 14.

Figure 13:
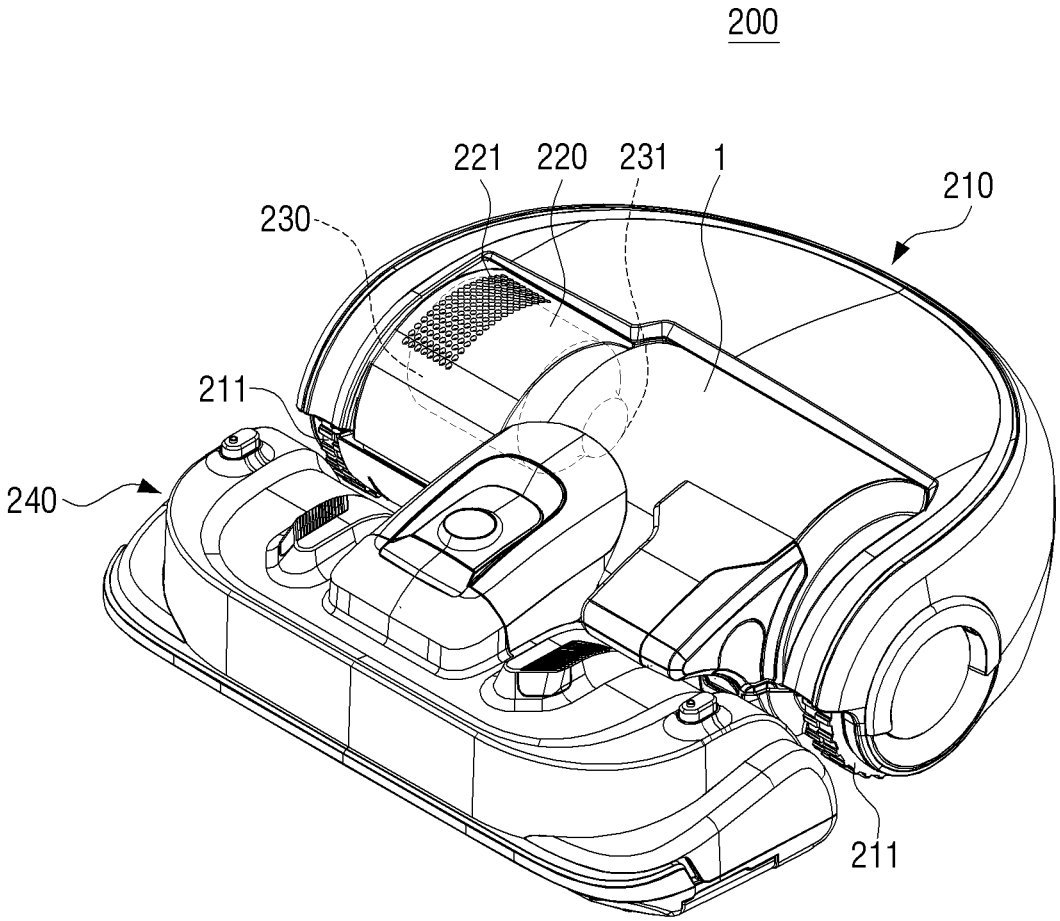
FIG. 13 is a view illustrating a robot cleaner having a multi-cyclone dust collecting device according to an embodiment of the disclosure.

When the multi-cyclone dust collecting device 1 according to an embodiment of the disclosure is used in the wireless stick cleaner 100 as illustrated in FIG. 11 or in the robot cleaner 200 as illustrated in FIG. 13, it is necessary to increase the suction force while making the size of the multi-cyclone dust collecting device 1 as small as possible.

To this end, the outer diameter D1 of the multi-cyclone dust collecting device 1 may be approximately 100 to 110 mm, and the outer diameter D2 of the intermediate chamber 17 in which the plurality of secondary cyclones 20 are disposed may be approximately 75 to 85 mm. In this case, as illustrated in FIG. 3, nine secondary cyclones 20 may be arranged. At this time, it may be appropriate that three inlets 30 are formed in the secondary cyclone 20. In this case, the secondary cyclone 20 may be formed to have two or four or more inlets 30, but the pressure loss may be greater than that in the case of having three inlets 30. When the outer diameter D1 of the multi-cyclone dust collecting device 1 and the outer diameter D2 of the intermediate chamber 17 are made larger, the secondary cyclone 20 may be formed to have four inlets 30. However, as in this embodiment, the multi-cyclone dust collecting device 1 used in a wireless stick cleaner or a robot cleaner having a size limitation may be formed so that each of the plurality of secondary cyclones 20 has three inlets 30.

FIGS. 9A to 9D are plan views illustrating a state in which a top plate is separated from a secondary cyclone of a multi-cyclone dust collecting device according to an embodiment of the disclosure.

Figure 9A:
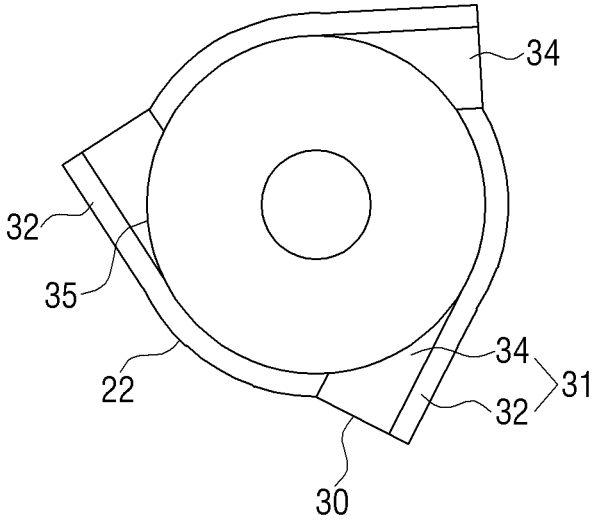
FIGS. 9A to 9D are plan views illustrating a state in which a top plate is separated from a secondary cyclone of a multi-cyclone dust collecting device according to an embodiment of the disclosure.

The opening 35, as illustrated in FIG. 9A, may be formed by cutting the side surface of the cylindrical portion 22 of the secondary cyclone 20 in the same way as the side of the bottom wall 34 of the inlet duct 31 in contact with the side surface of the cylindrical portion 22 of the secondary cyclone 20.

Figure 9B:
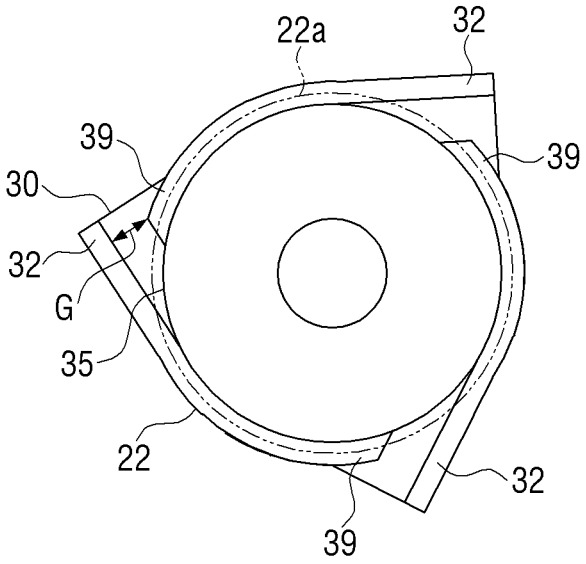
Figure 9C:
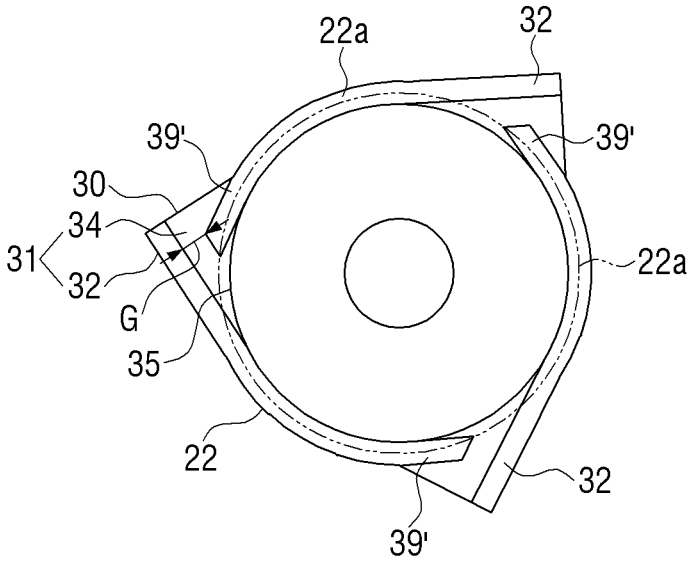
Figure 9D:
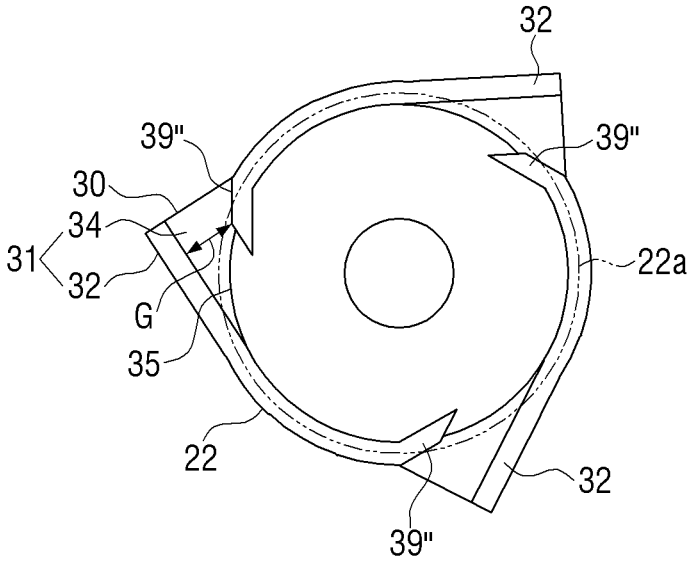

However, as another example, as illustrated in FIGS. 9B to 9D, an adjusting portion 39, 39', or 39" may be provided in the opening 35. The adjusting portion 39, 39', or 39" may be formed to extend toward the opening 35 from the side surface of the cylindrical portion 22 of the secondary cyclone 20 corresponding to the starting end of the inlet duct 31. The adjusting portion 39, 39', or 39" may adjust the cross-sectional area of the middle portion of the inlet duct 31 through which the air introduced into the inlet duct 31 passes.

The adjusting portion 39 may be formed to extend along the side surface of the secondary cyclone 20, that is, along a virtual circle 22*a* corresponding to the cylindrical portion 22, as illustrated in FIG. 9B. In this case, the adjusting portion 39 may reduce the area of the opening 35 compared to the opening 35 of the secondary cyclone 20 shown in FIG. 9A.

Alternatively, the adjusting portion 39' may be disposed inclined so that one end of the adjusting portion 39' faces the inflow guide wall 32 of the inlet duct 31, as illustrated in FIG. 9C. In other words, the adjusting portion 39' may be provided to be inclined toward the outside from the virtual circle 22*a* corresponding to the cylindrical portion 22. In this case, the distance G between the inflow guide wall 32 and the one end of the adjusting portion 39' is narrower than that of the adjusting portion 39 of FIG. 9B, and thus the cross-sectional area of the passage through which the air introduced into the inlet duct 31 passes may be narrowed.

Alternatively, the adjusting portion 39" may be disposed inclined so that one end of the adjusting portion 39" faces the inside of the secondary cyclone 20, as illustrated in FIG. 9D. In other words, the adjusting portion 39" may be provided to be inclined toward the inside from the virtual circle 22*a* corresponding to the cylindrical portion 22. In this case, the distance G between the inflow guide wall 32 and the one end of the adjusting portion 39" is wider than that of the adjusting portion 39 of FIG. 9B, and thus the cross-sectional area of the passage through which the air introduced into the inlet duct 31 passes may be widened. In the above, the distance G between the inflow guide wall 32 and one end of the adjusting portion 39, 39', or 39" refers to the length of a straight line drawn vertically from one end of the adjusting portion 39, 39', or 39" to the inflow guide wall 32.

In the above description, the body 21 of the secondary cyclone 20 includes the cylindrical portion 22 and the truncated cone 23 as illustrated in FIGS. 4 and 6. However, the shape of the body 21 of the secondary cyclone 20 is not limited thereto.

Figure 10:
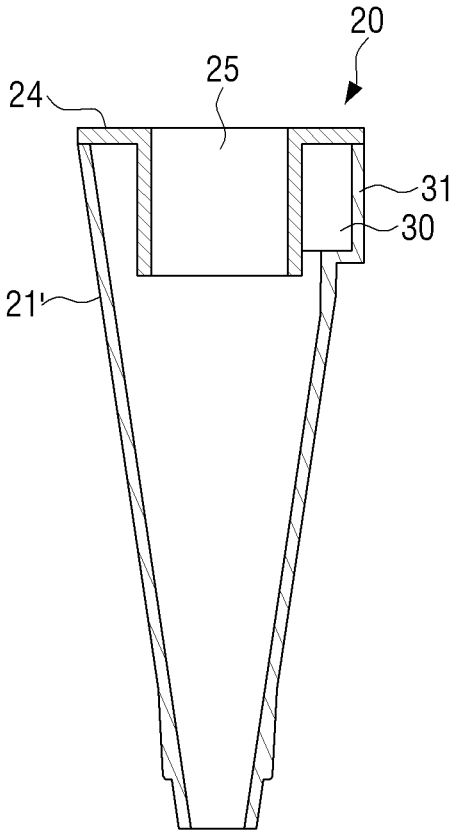
FIG. 10 is a longitudinal sectional view illustrating another example of a secondary cyclone of a multi-cyclone dust collecting device according to an embodiment of the disclosure.

A body 21' of the secondary cyclone 20 may be formed only in a truncated cone without a cylindrical portion as illustrated in FIG. 10. In this case, the plurality of inlets 30 may be formed on the upper end of the side surface of the truncated cone 21', and the outlet 25 may be provided on the top plate 24 disposed at the upper end of the truncated cone 21'. The shape of the inlet duct 31 forming the inlet 30 and the outlet 25 may be formed similar or identical to the inlet duct 31 and the outlet 25 of the secondary cyclone 20 described above; therefore, detailed descriptions thereof are omitted.

Hereinafter, an operation of the multi-cyclone dust collecting device according to an embodiment of the disclosure having the above-described structure will be described with reference to FIG. 2.

Dirt-containing air is introduced into the primary cyclone 10 through the inlet 11*b* (arrow A). The dirt-containing air introduced into the inlet 11*b* whirls inside the primary cyclone 10. While the dirt-containing air whirls inside the primary cyclone 10, the dirt is separated by the centrifugal force. In detail, the dirt-containing air is introduced into the interior of the housing 11 through the inlet 11*b* provided on one side of the housing 11, and then whirls in the space between the side wall of the housing 11 and the intermediate wall 12 that form the primary cyclone 10. At this time, dirt and dust contained in the dirt-containing air are separated by the centrifugal force, and fall into and collect in the dirt collecting chamber 44 provided on the bottom 11*a* of the housing 11.

Air from which the dirt has been removed is introduced into the intermediate chamber 17 through the porous member 13 provided in the intermediate wall 12 (arrow B).

The plurality of inlets 30 of the plurality of secondary cyclones 20 are open in the intermediate chamber 17. Accordingly, the air introduced into the intermediate chamber 17 is introduced into the bodies 21 of the plurality of secondary cyclones 20 through the plurality of inlets 30 of the plurality of secondary cyclones 20 (arrow C). At this time, because one secondary cyclone 20 is provided with a plurality of inlets 30, in the case of this embodiment, because three inlets 30 are provided in one secondary cyclone 20, air is introduced into one secondary cyclone 20 through three inlets 30. As described above, because air is introduced into the secondary cyclone 20 through the plurality of inlets 30, the pressure loss may be reduced.

The air introduced through the plurality of inlets 30 of the secondary cyclone 20 whirls inside the secondary cyclone 20. Accordingly, fine dust is separated by centrifugal force acting on the air whirling inside the secondary cyclone 20. The separated fine dust descends along the body 21 of the secondary cyclone 20 and falls into the dust collecting chamber 40 through the dust outlet 26.

The air from which fine dust has been removed in the plurality of secondary cyclones 20 is discharged to the base 50 through the outlet 25 of each of the plurality of secondary cyclones 20 (arrow D).

The air discharged to the base 50 is discharged to the outside of the multi-cyclone dust collecting device 1 through the upper end of the base 50 (arrow E).

The dirt collected in the dirt collecting chamber 44 of the housing 11 and the fine dust collected in the dust collecting container 41 may be disposed of by separating the housing 11 from the base 50.

In the multi-cyclone dust collecting device 1 according to an embodiment of the disclosure having the above-described structure, because air is introduced into each of the plurality of secondary cyclones 20 through the plurality of inlets 30, the pressure loss may be reduced while maintaining the separation efficiency.

The inventors conducted an experiment comparing the separation efficiency and pressure loss between the conventional multi-cyclone dust collecting device, in which each of a plurality of secondary cyclones has one inlet and one outlet, and the multi-cyclone dust collecting device 1 according to an embodiment of the disclosure, in which each of the plurality of secondary cyclones 20 has three inlets 30 and one outlet 25. The experimental results are shown in Table 1 below.

TABLE 1

| Category | Motor capacity (W) | Separation efficiency | Pressure loss |
|---|---|---|---|
| Prior art | 550 | 99% | 175 $mmH_2O$ |
| This disclosure | 550 | 99% | 90 $mmH_2O$ |

As can be seen from Table 1 above, in a vacuum cleaner using a motor of the same capacity, the multi-cyclone dust collecting device 1 according to an embodiment of the disclosure has the separation efficiency of 99% and maintains the same as that of the conventional multi-cyclone dust collecting device, while the pressure loss is reduced from 175 $mmH_2O$ to 90 $mmH_2O$. Accordingly, when the number of inlets 30 of the secondary cyclone 20 is increased as the multi-cyclone dust collecting device 1 according to this disclosure, the pressure loss may be reduced so that the performance of the vacuum cleaner may be improved. Hereinafter, a vacuum cleaner having a multi-cyclone dust collecting device according to an embodiment of the disclosure will be described.

First, a case in which a multi-cyclone dust collecting device according to an embodiment of the disclosure is applied to a wireless stick cleaner will be described.

Figure 12:
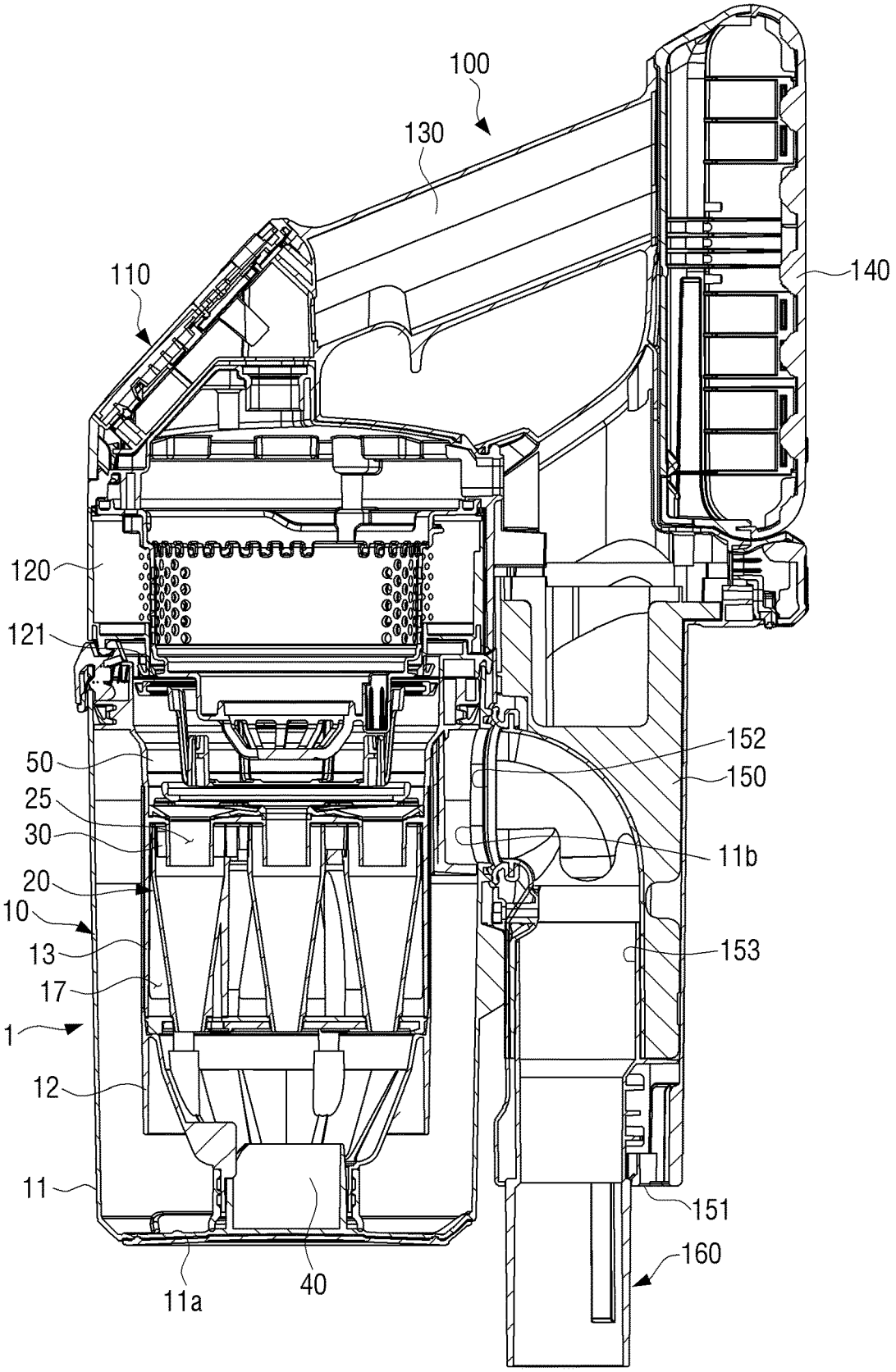
FIG. 12 is a partial cross-sectional view illustrating the multi-cyclone dust collecting device disposed in the wireless stick cleaner of FIG. 11.

FIG. 11 is a view illustrating a wireless stick cleaner having a multi-cyclone dust collecting device according to an embodiment of the disclosure, and FIG. 12 is a partial cross-sectional view illustrating the multi-cyclone dust collecting device disposed in the wireless stick cleaner of FIG. 11.

Referring to FIGS. 11 and 12, the wireless stick cleaner 100 according to an embodiment of the disclosure may include a main body 110, a multi-cyclone dust collecting device 1, and an extension pipe 160.

The main body 110 may include a suction motor 120 configured to generate a suction force, a handle 130 to allow the wireless stick cleaner 100 to be gripped, a battery 140 configured to supply power to the suction motor 120, and a connecting portion 150 to which the extension pipe 160 is connected.

A mounting portion 121 to which the base 50 of the multi-cyclone dust collecting device 1 is mounted may be provided on one side of the suction motor 120. Accordingly, the air from which dirt and dust are removed while passing through the multi-cyclone dust collecting device 1 passes through the suction motor 120, and then is discharged to the outside of the wireless stick cleaner 100.

The handle 130 may be disposed on the upper end of the wireless stick cleaner 100, and may be formed so that a user manipulates the wireless stick cleaner 100 by holding the handle 130 by hand. The handle 130 may be provided with a switch (not illustrated) for turning on/off the power of the wireless stick cleaner 100.

The battery 140 may be a rechargeable battery that can be charged using an external power source.

One end 151 of the connecting portion 150 may be formed so that the extension pipe 160 is attached to and detached from the one end 151, and the other end 152 thereof may be formed to communicate with the inlet 11*b* of the primary cyclone 10 of the multi-cyclone dust collecting device 1. A connection passage 153 through which dirt-containing air sucked from the outside passes may be provided between one end 151 and the other end of the connecting portion 150. Accordingly, when the extension pipe 160 is disposed at one end 151 of the connecting portion 150, external air is introduced into the multi-cyclone dust collecting device 1 through the extension pipe 160 and the connection passage 153.

One end of the extension pipe 160 may be formed to be connected to the connecting portion 150 of the main body 110, and the other end thereof may be provided with a suction nozzle 170 that moves along the surface to be cleaned and sucks dirt and dust from the surface to be cleaned.

When the power of the wireless stick cleaner 100 is turned on, the suction motor 120 rotates to generate a suction force. When the suction force is generated, dirt-containing air including dirt and dust on the surface to be cleaned may be introduced into the extension pipe 160 through the suction nozzle 170.

The dirt-containing air introduced into the extension pipe 160 may be introduced into the inlet 11*b* of the multi-cyclone dust collecting device 1 through the connecting portion 150 of the main body 110.

The dirt-containing air introduced into the inlet 11*b* of the multi-cyclone dust collecting device 1 whirls in the primary cyclone 10. While the dirt-containing air whirls in the primary cyclone 10, the dirt is separated from the dirt-containing air by the centrifugal force and collected on the bottom 11*a* of the housing 11.

Air from which the dirt is separated is introduced into the plurality of secondary cyclones 20 provided in the intermediate chamber 17 through the porous member 13 provided on the intermediate wall 12. At this time, air is introduced into the secondary cyclones 20 through the plurality of inlets 30 provided in each of the plurality of secondary cyclones 20.

While the air introduced through the plurality of inlets 30 whirls inside the plurality of secondary cyclones 20, fine dust is separated by centrifugal force and falls along the body of the secondary cyclone 20. The fine dust separated by the secondary cyclones 20 is collected into the dust collecting chamber 40 through the dust outlets.

Clean air from which the fine dust has been separated is discharged to the base 50 through the plurality of outlets 25 of the plurality of secondary cyclones 20. Because the base 50 is connected to the suction motor 120, the air discharged to the base 50 is discharged to the outside of the wireless stick cleaner 100 through the suction motor 120.

FIG. 13 is a view illustrating a robot cleaner having a multi-cyclone dust collecting device according to an embodiment of the disclosure.

Referring to FIG. 13, a robot cleaner 200 according to an embodiment of the disclosure may include a cleaner body 210 and a suction nozzle 240.

The cleaner body 210 may include a multi-cyclone dust collecting device 1 configured to collect the introduced dirt and a suction motor 230 configured to generate a suction force capable of sucking the dirt. In addition, the cleaner body 210 may include a plurality of wheels 211 that allow the robot cleaner 200 to move, a drive part (not illustrated) configured to drive the plurality of wheels 211, a position detecting sensor (not illustrated) configured to detect the position of the robot cleaner 200, and a processor (not illustrated) configured to control the drive part and the suction motor 230. Accordingly, the processor may control the robot cleaner 200 to run autonomously, and may clean the surface to be cleaned using the suction motor 230 and the multi-cyclone dust collecting device 1.

The multi-cyclone dust collecting device 1 separates and collects the dirt from the dirt-containing air sucked by the suction force generated by the suction motor 230, and then discharges air from which the dirt has been removed to the suction motor 230 through the outlet. The multi-cyclone dust collecting device 1 includes the primary cyclone 10 and the plurality of secondary cyclones 20 as described above.

The suction nozzle 240 is connected to the inlet 11*b* (see FIG. 2) of the multi-cyclone dust collecting device 1. The suction nozzle 240 may be disposed to be rotatable with respect to the cleaner body 210.

The suction motor 230 is connected to the multi-cyclone dust collecting device 1, and generates a suction force to suck air together with the dirt into the multi-cyclone dust collecting device 1. A suction port 231 of the suction motor 230 is connected to the base 50 (see FIG. 1) of the multi-cyclone dust collecting device 1.

The cleaner body 210 may be provided with a fixing part 220 in which the suction motor 230 is disposed. A discharge port 221 through which the air that has passed through the suction motor 230 is discharged may be provided at one side of the fixing part 220.

Therefore, when the processor of the robot cleaner 200 turns on the suction motor 230, an impeller of the suction motor 230 rotates to generate a suction force. Then, dirt and dust on the surface to be cleaned are sucked together with air through the suction nozzle 240, and then separated and collected by the multi-cyclone dust collecting device 1. The air from which the dirt and dust have been removed is discharged from the multi-cyclone dust collecting device 1, passes through the suction motor 230, and then is discharged to the outside of the cleaner body 210 through the discharge port 221 of the cleaner body 210.

Although embodiments of the disclosure have been illustrated and described hereinabove, the disclosure is not limited to the abovementioned specific embodiments, but may be variously modified by those skilled in the art to which the disclosure pertains without departing from the gist of the disclosure as disclosed in the accompanying claims. These modifications should also be understood to fall within the scope of the disclosure.

The invention claimed is:

1. A vacuum cleaner comprising:

a suction nozzle;

a multi-cyclone dust collecting device connected to the suction nozzle; and a suction motor connected to the multi-cyclone dust collecting device and configured to generate a suction force, wherein the multi-cyclone dust collecting device comprises:

a primary cyclone formed to firstly separate dirt from an introduced dirt-containing air; an intermediate wall that is disposed in a cylindrical shape inside the primary cyclone and includes a porous member; and a plurality of secondary cyclones disposed inside the intermediate wall and formed to separate fine dust from air discharged through the porous member of the intermediate wall from the primary cyclone, each of the plurality of secondary cyclones including a at least three inlets and one outlet, wherein the at least three inlets provided in each of the plurality of secondary cyclones protrude outward from a body of each of the plurality of secondary cyclones and include an inlet duct formed in a tangential direction with respect to an outer circumferential surface of each of the plurality of secondary cyclones, wherein an entrance of the inlet duct is located at a position lower than an upper end of the porous member of the intermediate wall, wherein the outlet of each of the plurality of secondary cyclone includes a discharge pipe and a lower end of the discharge pipe is positioned at a same level as or at a lower level than a lower end of the inlet duct provided at each of the at least three inlets, wherein each of the at least three inlets comprises:

an opening formed in each of the plurality of secondary cyclones, and the inlet duct is formed to surround the opening, wherein the inlet duct comprises:

an inflow guide wall disposed in a tangential direction with respect to the outer circumferential surface of the secondary cyclone;

a top wall connecting an upper end of the inflow guide wall and an upper end of the secondary cyclone; and a bottom wall disposed in parallel with the top wall and connecting a lower end of the inflow guide wall and the outer circumferential surface of the secondary cyclone, and wherein each of the at least three inlets further includes an adjusting portion extending from the outer circumferential surface of the secondary cyclone corresponding to a start end of the inlet duct toward the opening.

2. A multi-cyclone dust collecting device comprising:

a primary cyclone formed to firstly separate dirt from an introduced dirt-containing air;

an intermediate wall that is disposed in a cylindrical shape inside the primary cyclone and includes a porous member; and a plurality of secondary cyclones disposed inside the intermediate wall and formed to separate fine dust from air discharged through the porous member of the intermediate wall from the primary cyclone, each of the plurality of secondary cyclones including at least three inlets and an outlet, wherein the at least three inlets provided in each of the plurality of secondary cyclones protrude outward from a body of each of the plurality of secondary cyclones and include an inlet duct formed in a tangential direction with respect to an outer circumferential surface of each of the plurality of secondary cyclones, wherein an entrance of the inlet duct is located at a position lower than an upper end of the porous member of the intermediate wall, wherein the outlet of each of the plurality of secondary cyclone includes a discharge pipe and a lower end of the discharge pipe is positioned at a same level as or at a lower level than a lower end of the inlet duct provided at each of the at least three inlets, wherein each of the at least three inlets comprises:

an opening formed in each of the plurality of secondary cyclones, and the inlet duct is formed to surround the opening, wherein the inlet duct comprises:

an inflow guide wall disposed in a tangential direction with respect to the outer circumferential surface of the secondary cyclone;

a top wall connecting an upper end of the inflow guide wall and an upper end of the secondary cyclone; and a bottom wall disposed in parallel with the top wall and connecting a lower end of the inflow guide wall and the outer circumferential surface of the secondary cyclone, and wherein each of the at least three inlets further includes an adjusting portion extending from the outer circumferential surface of the secondary cyclone corresponding to a start end of the inlet duct toward the opening.

3. The multi-cyclone dust collecting device of claim 2, wherein a cross-sectional area of each of the at least three inlets is less than or equal to an cross-sectional area of the outlet.

4. The multi-cyclone dust collecting device of claim 2, wherein the adjusting portion extends along a virtual circle corresponding to the outer circumferential surface of the secondary cyclone.

5. The multi-cyclone dust collecting device of claim 2, wherein the primary cyclone is configured to discharge air into an intermediate chamber, and the at least three inlets of each of the plurality of secondary cyclones are provided to open toward the intermediate chamber.

6. The multi-cyclone dust collecting device of claim 2 comprising:

a housing forming the primary cyclone;

a dust collecting chamber provided under the plurality of secondary cyclones and configured to collect fine dust separated in the plurality of secondary cyclones;

a lower plate disposed inside the intermediate wall to partition between lower ends of the plurality of secondary cyclones and the dust collecting chamber; and an upper plate disposed on the upper ends of the plurality of secondary cyclones to block a space between the plurality of secondary cyclones.

7. The multi-cyclone dust collecting device of claim 6, wherein the porous member is disposed along an entire circumference at a portion of the intermediate wall corresponding between the upper plate and the lower plate.

8. The multi-cyclone dust collecting device of claim 2, wherein the at least three inlets are provided on an upper end of the outer circumferential surface of each of the plurality of secondary cyclones.

9. The multi-cyclone dust collecting device of claim 8, wherein each of the plurality of secondary cyclones comprises:

a hollow cylindrical portion provided with the at least three inlets;

a hollow truncated cone provided at a lower end of the hollow cylindrical portion; and a top plate disposed on an upper end of the cylindrical portion and provided with the outlet.

10. The multi-cyclone dust collecting device of claim 9, wherein the cylindrical portion is integrally formed with the truncated cone, and the top plate is formed separately from the cylindrical portion.

* * * * *